United States Patent [19]

Stokes et al.

[11] 4,316,611

[45] Feb. 23, 1982

[54] COMPETITION GAME MACHINE

[76] Inventors: W. Fred Stokes, Rte. 2, Branchville, S.C. 29432; Fairey S. Bradford, 909 4th Ave., Kingstree, S.C. 29556; Nancy S. Strobel, 901 Wisteria Dr., Florence, S.C. 29501

[21] Appl. No.: 161,450

[22] Filed: Jun. 20, 1980

[51] Int. Cl.[3] ..... A63F 7/06; A63F 7/14

[52] U.S. Cl. ..... 273/85 D; 273/85 C; 273/119 R; 273/357; 273/85 E; 124/6; 124/79

[58] Field of Search ..... 273/85 C, 85 D, 85 E, 273/85 F, 119 R, 357, 85 G, 85 R

[56] References Cited

U.S. PATENT DOCUMENTS

| | | | |
|---|---|---|---|
| 935,585 | 9/1909 | Campbell | 273/85 E |
| 1,827,885 | 10/1931 | Emenhiser | 273/357 X |
| 3,537,707 | 11/1970 | Goldberg | 273/85 D X |
| 3,947,031 | 3/1976 | Goldfarb et al. | 273/85 E X |
| 3,977,675 | 8/1976 | Leuthy | 273/85 D |
| 4,119,315 | 10/1978 | Goldfarb et al. | 273/85 F |

FOREIGN PATENT DOCUMENTS

| | | | |
|---|---|---|---|
| 512456 | 7/1952 | Belgium | 273/85 D |
| 1114892 | 12/1955 | France | 273/85 E |

*Primary Examiner*—George J. Marlo

*Attorney, Agent, or Firm*—Watson, Cole, Grindle & Watson

[57] ABSTRACT

A game machine which can be played by two or more players includes an elongated box-like housing in which a game ball can be inserted, the housing including elongated side members with transparent windows therein and opposed end members with openings in their upper portions through which the game ball can be projected, the housing also including two projector elements in respective opposite ends thereof which are capable of utilization by competing players to project the game ball towards the opposite end member, and at least two activator elements in the housing between the two projector elements which are capable of utilization by competing players to contact and move a game ball in the desired fashion. A flooring structure inside the housing forms a contoured playing deck surface above the bottom of the housing and provides multiple, uniform and equally spaced-apart spaces which extend from one end member of the housing to the other. The projector elements and the activator elements include portions which can move within these spaces from a positioning below the playing deck surface to varying positionings above the playing deck surface so as to cause suitable manipulations of the game ball, including dribbling, when contacted by the noted projector element and activator element portions.

11 Claims, 12 Drawing Figures

92
89
91
90
84
85
88
86
87
122
123
124
200
200
201
202
50

COMPETITION GAME MACHINE

BACKGROUND OF THE INVENTION

1. Field of the Invention

The present invention relates to a portable game machine comprised of an elongated housing in which a game ball can be inserted and then moved towards a goal located at either end by suitable manipulation of elements within the machine by two or more game players positioned on either side of the housing.

2. The Prior Art

Competitive game machines that comprise a housing in which a projectile can be moved towards opposite ends by the manipulation of elements within the housing are well known. Many of these game machines are constructed such that when played they will simulate the playing of a basketball game.

One known game machine which can be used by a single player to play a type of game which represents a combination of simulated basketball, golf and skeeball is shown in U.S. Pat. No. 3,537,707 (Goldberg). This device comprises an elongated housing which has a basket-like goal mounted on one housing end wall and which includes a throwing device mounted to extend between and through slots in the side walls of the housing near the opposite housing end wall. The throwing element comprises a rotatable shaft and a holding member fixedly mounted to its center, the holding member including a sloping lip for cupping a game ball. The ends of the rotatable shaft are separately translatable along the side wall slots, and the shaft is also freely rotatable so as to cause the holding member to project a game ball positioned in the holding member towards the basket-like goal. The game ball can be picked up from the smooth, inclined base of the device by both the appropriate sideways or translatable movement of the rotatable shaft, as well as its timely rotation.

A somewhat more complicated game machine is shown in U.S. Pat. No. 3,977,675 (Leuthy). In this device, which can be played by two or more players, an elongated housing has identical barriers positioned near the opposite housing end walls (the barriers having a lesser height than the housing end walls) to form goal areas therebehind (each barrier including a goal opening in its lower side located in contact with the flat floor 4 of the housing), and also positioned therein between the barriers are multiple projector elements. Each of the projector elements comprises an elongated rotatable shaft which extends between and through holes in the housing side walls, and a plurality of paddles are fixedly connected to each rod, each paddle being capable of contacting and projecting a game ball inside the housing towards either barrier, e.g., either along the housing floor or in the air, depending on how it is manipulated.

A much differently constructed game machine is shown in U.S. Pat. No. 3,947,031 (Goldfarb et al). In this device, which comprises a very narrow elongated housing in which a game disk is projected towards baskets located on the opposite housing end walls, a number of player character-figures and two goal-keeper character-figures are positioned in the housing to manipulate and control the movement of the game disk. Each player character-figure is not only vertically movable, but each includes oppositely directed arms which are separately pivotable around separate pivot pins attached to the head section, with each arm being connected via a linkage system to a lever handle located on the outer side of opposite housing side walls. These arms (which overlap in the longitudinal dimension of the housing with the arms of the next adjacent player character-figure) effectively form the floor of the game machine. Separate linkage systems operable by game players on opposite sides of the game machine can cause the opposing goalkeeper character-figures to rise and fall within the housing and thus, by way of vertically-extending arm portions thereof, block the entry of the game disk into the adjacent basket.

It is an object of the present invention to provide a competition game machine which is portable, which is operable without batteries, which will be constructed so as to help the players thereof develop coordination, timing and other skills often obtained only in actual physical sports participation, and which can have its operating characteristics easily modified by, for example, changing the size and weight of the game ball used therein or changing the contour of the playing deck surface located therein (this being the surface which will function as the bottom of the game ball playing zone within the game machine).

SUMMARY OF THE PRESENT INVENTION

In accordance with the present invention the competition game machine will include an elongated housing composed of an elongated cover member, elongated side members, end members and an elongated bottom member, the housing having a generally box-like shape, and operatively positioned within the housing are movable elements which can be individually operated by players positioned on either one side or the other of the housing so as to move a game ball towards either one end member of the housing or the other. Each housing end member will include an opening in its upper portion through which a game ball may pass so as to constitute a score for the appropriate game player, and each side member will include an elongated opening in which a transparent window is positioned. A game ball return device is mounted on the outer side of each end member to convey a game ball passed through the adjacent end member opening to a location where it can be easily retrieved by the opposing game player, and the cover member will include a centrally located opening for the introduction of a game ball into play within the housing.

The housing will include a flooring structure therein, the flooring structure providing a playing deck surface located above the housing bottom which will function as the bottom of the game ball playing zone within the housing. The flooring structure will not only be suitably constructed to provide multiple longitudinal playing deck portions which will have differing shapes and orientations, but will include a multiplicity of uniform spaces therein which will extend from one end member of the housing to the other and will be equally spaced apart between the housing side members. The spaces will be small enough in width that a game ball intended for use in the housing will not fall therethrough. The flooring structure can, for example, be composed of multiple spaced apart slats extending upwardly from one or more base portions supported on the housing bottom member, or else it can be composed of a grate having multiple elongated teeth extending between supports which will be mounted on the bottom member of the housing and respectively located adjacent the opposite housing end members.

Operatively positioned within the housing at opposite ends thereof are separate projector elements which are respectively utilized by competing game players, each projector element including a rotatable shaft that extends between the housing side members and through aligned holes in the lower portions thereof, a handle connected to one end of the rotatable shaft outside the housing, and a projector hub fixedly mounted to the portion of the rotatable shaft located between the housing side members. The projector hub will include multiple spaced apart projector arms which are capable of fitting within appropriate spaces created in the flooring structure. Manual movement of the noted handle by one of the appropriate game players will cause the rotatable projector element shaft to rotate and thus the projector arms to move upwardly through the spaces in the flooring structure and thereby project a game ball supported by head portions of the projector arms towards the opposite housing end members.

Operatively positioned within the housing and between the two projector elements are at least two translatable and rotatable activator elements which are respectively utilized by competing game players, each activator element including a yoke having two arms and a cross bar connecting first ends thereof, the cross bar being itself rotatably mounted between the housing side members, and the second ends of the arms including aligned bores through which a rotatable shaft extends. The noted rotatable activator shaft of each activator element will extend through aligned crescent-shaped slots formed in the housing side members. One end of each rotatable activator shaft will include an enlarged end portion for gripping by the appropriate game player. Fixedly attached to each rotatable activator shaft along a portion located between the housing side members is a fin hub which will include multiple spaced apart fins which are capable of fitting within appropriate spaces created in the flooring structure (the fins of one activator element fitting within different spaces than the fins of the next adjacent activator element). Manual gripping of the enlarged end portion of the rotatable activator shaft will allow the appropriate game player to both (and possibly simultaneously) translate the shaft within the crescent-shaped slots in the housing side members by rotation of the yoke about its cross bar portion, as well as rotate the shaft, such that the fin hub fins can be moved along and extended above the playing deck surface. Thus, contact with and suitable movement of the game ball in the housing by these activator elements can be achieved.

The activator elements will be preferably positioned along the length of the game machine housing such that when adjacent pairs are individually rotated by opposing game players towards one another about the cross bar of their yokes and thus translated within the crescent-shaped slots in the housing side members, their fins will overlap one another in the longitudinal dimension of the housing; whereas when they are rotated and translated away from one another, their fins will be free of interaction with one another and thus able to contact and suitably move a game ball in an unimpedible fashion.

Further objects, advantages and features of the present invention will be apparent in the arrangement and construction of the constituent parts in detail as set forth in the following description taken in conjunction with the accompanying drawings.

DETAILED DESCRIPTION OF THE PREFERRED EMBODIMENTS

Figure 1:
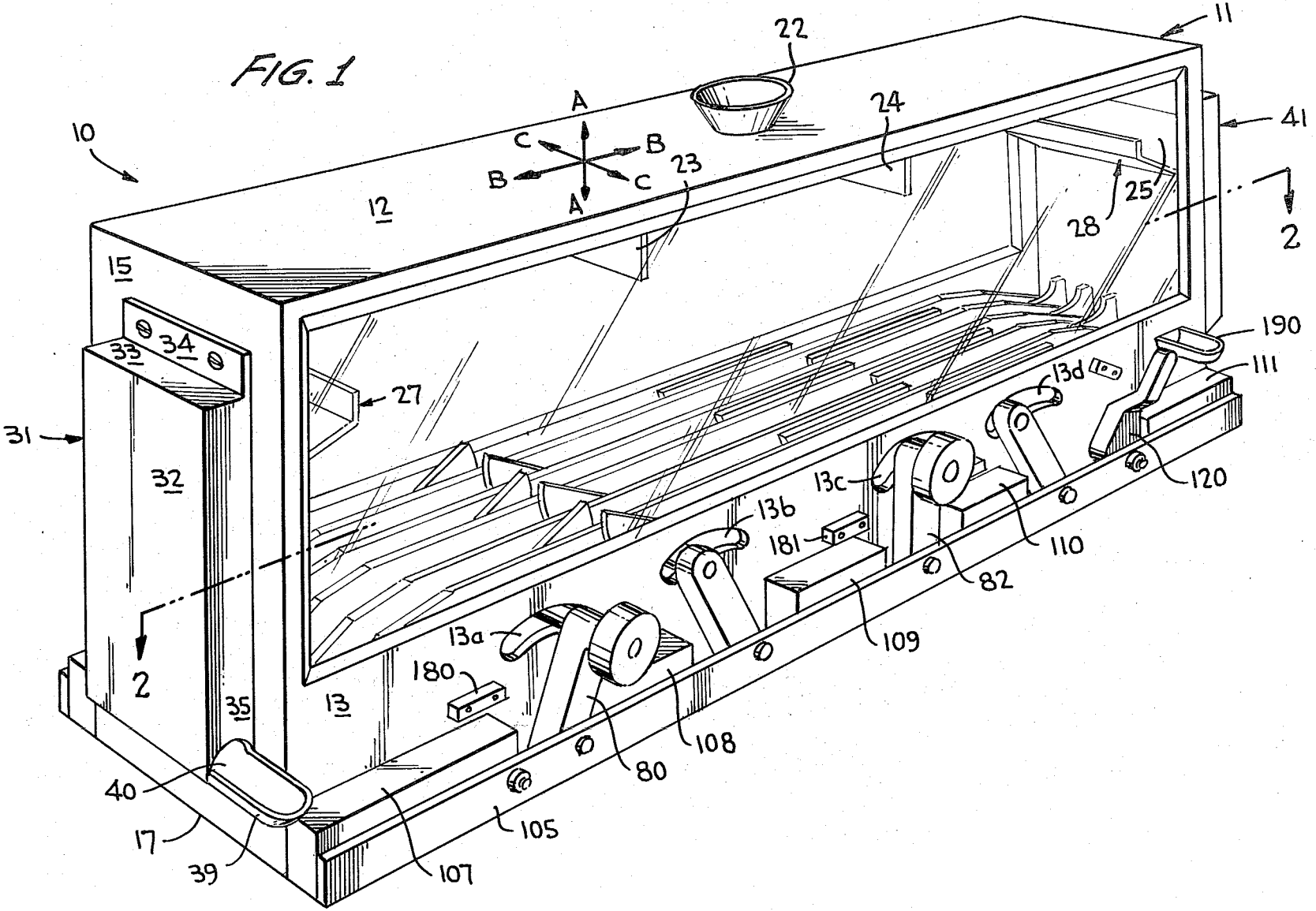
FIG. 1 shows a perspective view of a preferred embodiment of competition game device constructed in accordance with the present invention.

One embodiment of a competition game machine constructed in accordance with the present invention is shown in a perspective view in FIG. 1. This machine, labeled 10, is seen to have an overall elongated, generally box-like shape which allows it to operate on any flat and horizontal supporting surface such as a table top. At the same time, the machine will have a sufficient weight that it will remain essentially stationary when the movable components therein are being manipulated during the course of competitive operation of the machine. Thus, the various components of the machine can be made of either metallic materials and/or impact-resistant plastics, although impact-resistant plastic such as polypropylene and polystyrene are preferred due to their easy moldability, low cost and high durability.

Figure 3:
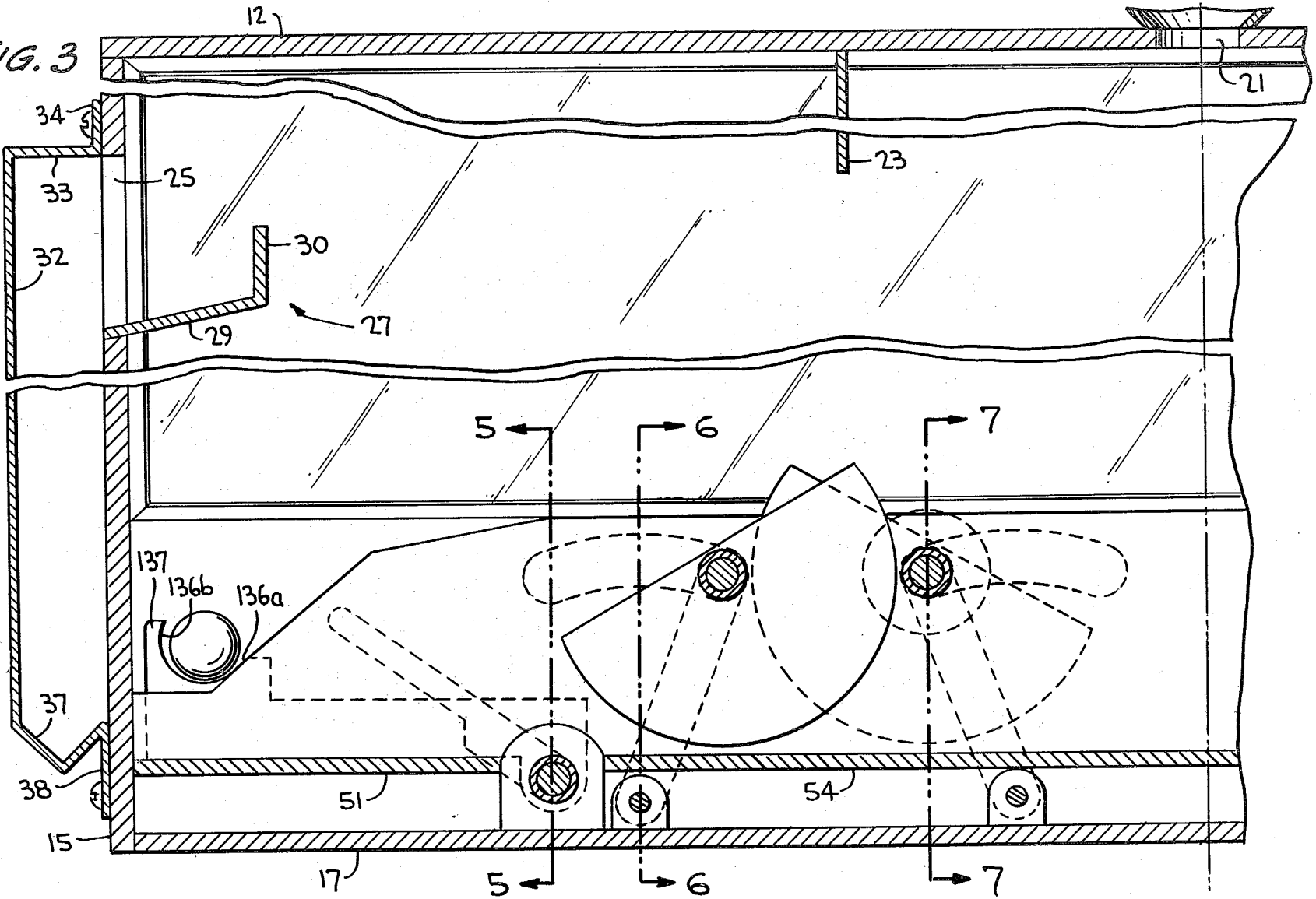
FIG. 3 shows on an enlarged scale a partially cut away cross sectional side view of the competition game device as seen along line 3—3 of FIG. 2.

Considering the machine 10 in more detail, its basic design is created by a housing 11 which is formed by an elongated rectangularly-shaped cover member 12, two opposed elongated rectangularly-shaped side members 13 and 14, two opposed rectangularly-shaped end members 15 and 16, and an elongated rectangularly-shaped bottom member 17 (see FIG. 3). These members are connected to each other at their various side edges by suitable means such as screws (not shown). It is within housing 11 that the manipulation of the game ball will take place. In the following discussion the terms "inner" or "inwardly" and "outer" or "outwardly" will refer to whether or not the surfaces of the associated structural elements will face towards or away from the inside of the housing 11, the terms "upwardly" and "downwardly" will refer to the directions of the associated structural elements along line A—A as shown in FIG. 1, and the terms "longitudinal" and "transverse" will refer to directions along lines B—B and C—C, respectively, in FIG. 1.

Referring now to the two side members 13 and 14, each of these members includes a large elongated rectangular opening in its upper portion which extends along almost the entire longitudinal dimension of the side member. Fixedly embedded by suitable retention means (not shown in detail) in the rectangular openings of each side member are identical transparent windows 18 and 19. These two opposing transparent windows will allow for a full viewing from either side of the machine 10 of the activities taking place inside the housing 11. The side members 13 and 14 also each include four longitudinally spaced apart, crescent shaped slots (note slots 13*a*, 13*b*, 13*c* and 13*d* in side member 13 shown in FIG. 1), the respective slots in side member 14 being aligned with corresponding slots in side member 13 transversely of the housing 11. Portions of the game machine activator elements will reciprocatingly move within these slots as suggested in FIG. 1. The side members 13 and 14 will also include a number of aligned openings (not shown in FIG. 1) near or at their bottom edges, through which rotational portions of both the activator and projector elements of the game machine will extend. The relative sizes and locations of these openings will be discussed in more detail below.

The cover member 12 includes at the center thereof a circular opening 21 (see FIG. 3), and fixedly attached to the outer side of cover member so as to extend upwardly from the rim of opening 21 is a funnel means 22. This funnel means 22 acts to help direct a game ball through opening 21 and into play inside of housing 11. At the same time, attached to extend downwardly from the inner side of cover member 12 in a fashion so as to be oriented transversely of the housing 11 are two identical baffle elements 23 and 24, these elements being spaced apart in the longitudinal direction of housing 11 and symmetrically positioned on opposite sides of the opening 20. These baffle elements will act to interfere with the trajectory of a game ball which hits the sides of either element during operation of the machine.

As can be seen from a review of FIGS. 1 and 3, each of the end members 15 and 16 (which are identical in construction) includes a rectangularly-shaped opening 25 in its upper portion (the smallest dimension of each opening 25 being larger than the largest game ball which can be introduced into housing 11 through opening 21), and attached to each end member so as to extend within housing 11 is a goal means 27 and 28. As shown in FIG. 3 which shows only the left-hand goal means 27, each goal means includes a floor portion 29 and a rim portion 30. The floor portion is mounted along one side to the adjacent end member along the lower edge of opening 25 so as to extend with an upward inclination within the housing 11, and the rim portion 30 is attached along one side to the opposite (upper) edge of the floor portion 28 so as to extend generally vertically upwardly within the housing.

Cooperable with the openings 25 in each end member 15 and 16 are identical game ball return means 31 and 41 which are respectively mounted on the outer sides of the two respective end members. As can be seen from FIGS. 1 and 3, each return means includes a backstop wall 32, a top wall 33, a perpendicular mounting flange 34, opposed lateral walls 35 and 36, a bottom return trough 37, and a perpendicular mounting flange 38. The top wall 33, the lateral walls 35 and 36 and the return trough 37 are all of a sufficient size to assure that the distance between the backstop wall 32 and the adjacent end member will be greater than the largest possible game ball diameter, and the return means will be mounted on the adjacent end members via flanges 34 and 38 (the connection means being shown but not labeled) such that the opening 25 in the adjacent end wall will open internally of the respective return means.

The return trough 37 is shown in FIG. 3 to have a V-shaped cross section. One end of the trough is connected to a V-shaped lower end of lateral wall 36 (not shown), while a portion of the outer side of the trough is connected to the lower edge of the backstop wall 32 and an intermediate portion is connected to the lower end of lateral wall 35. The trough can be seen to also include a cup-shaped end portion 39 which extends laterally beyond the lateral wall 35. The return trough is fashioned so as to be inclined downwardly to a slight extent between its end connected to lateral wall 36 and its cup-shaped end portion 39 which extends beyond lateral wall 35. At the same time, the lateral wall 35 includes a curved indentation 40 at the lower end thereof. Thus, a game ball which has been projected into the goal means 27 and has rolled down inclined floor portion 29 to pass through the opening 25 in the adjacent end member, will fall through the associated return means and land on the return trough 37, and thereafter roll along the return trough 37 through identation 40 in the lateral wall 35 and finally lodge in the cup-shaped end portion 39 for easy retrieval.

of course since the return means 31 and 41 are mounted on opposite end members 5 and 16 of housing 11, the respective cup-shaped end portions 39 thereof will extend in opposite transverse directions and respectively act to return game balls to players positioned on opposite sides of the machine.

Turning now to a further consideration of the structure inside of housing 11, positioned therein so as to be supported on the bottom member 17 is an elongated floor means 50 which extends as a unit generally along the entire distance between end members 15 and 16 and across the entire distance between side end members 13 and 14. The floor means 50, which is shown in detail in FIG. 4, comprises three spaced apart, rectangular base portions 51, 54 and 56 which are each respectively supported above the bottom member 17 of housing by suitable support flanges (note support flanges 52, 53, 55 and 57 shown in FIG. 4), such that the base portion will determine an imaginary plane parallel to the plane formed by bottom member 17 of housing 11. Base portion 54 has a longer longitudinal dimension that either of portions 51 or 57 (whose longitudinal dimensions are equal), and the transverse channels created between the base portions are identified in FIG. 4 as channels X and Y.

Connected to extend upwardly from the base portions 51, 54 and 57 are five transversely spaced apart unitary slat members 58–62 which, when the floor means 50 is positioned within housing 11, will extend in parallel with the side members 13 and 14 of housing 11. The thicknesses of the slat members and their positioning on base portions 51, 54 and 57 will be such that uniform spaces 64–69 will be created not only between the slat members but also between the outermost slat members 58 and 62 and the side members 13 and 14 (see FIG. 5). These spaces will have a significantly lesser width than the diameter of any game ball which will be utilized within the housing. The upper edges of the five slat members will form the playing deck for the game ball placed within the housing 11.

When viewed from the side, the upper edges of each slat member will have an elongated linear center upper edge portion 73 which extends parallel to the base portion 54, this center portion comprising a large part of the longitudinal extent of the upper edge, opposite first descending upper edge portions 74, opposite second descending upper edge portions 75, and opposite terminal upper edge portions 76.

Figure 4:
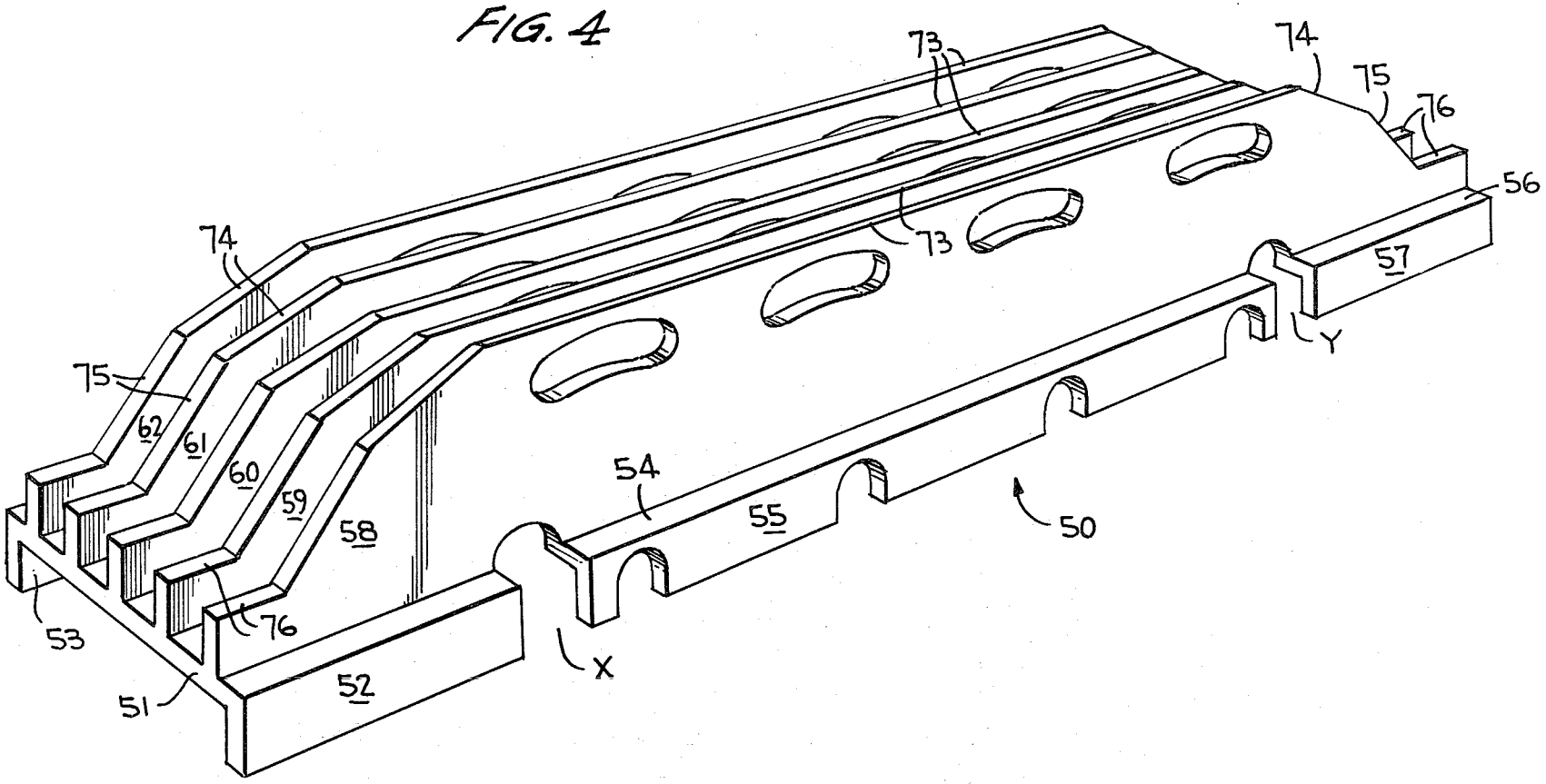
FIG. 4 shows a perspective view of the floor structure which is fixedly positioned inside the competition game device of FIG. 1.

In the present embodiment of the present invention, each of the slat members 58–62 will be similarly shaped and sized; however, as indicated in FIG. 4 the vertical heights above base portions 51, 54 and 57 of the center upper edge portions 73 of the outermost slat members 58 and 62, although equal to each other, will be greater than the corresponding vertical heights of the center upper edge portions 73 of slat members 59 and 61, which in turn will be equal to each other but greater than the corresponding vertical height of the center upper edge portion 73 of slat member 60. Thus, as can be seen from FIG. 5, the center portions of the upper edges of the slat members will extend upwardly from the base portions 51, 54 and 57 so as to together create a center portion of the playing deck which will display a slightly concave surface upon which the game ball may roll. On the other hand, the opposite first and second descending upper edge portions and the opposite terminal upper edge portions of the slat members will together create opposite first and second descending playing deck portions, as well as opposite terminal playing deck portions, which will display planar surfaces upon which the game ball may roll.

Of course in different embodiments of the present invention the various slat members can have differing shapes and sizes to create playing decks having differing characteristics. For example, the various slat members can be identically shaped and identically sized such that not only the opposite first and second descending upper edge portions and the opposite terminal edge portions of the various slat members will form corrsponding playing deck portions displaying planar surfaces, but such that the center portion of the playing deck will display a planar surface as well. Alternatively, the various slat members can be similarly shaped but differently sized such that the first and second descending upper portions and the opposite terminal upper edge portions will form corresponding playing deck portions displaying a slightly concave surface similarly to the center portion of the playing deck in the presently described embodiment. Finally, the center upper edge portions and the first and second opposite descending upper edge portions may be nonlinearly shaped.

In any event, the slat members 58–62 will be shaped and sized such that the center portion of the playing deck will be located adjacent the bottom edges of transparent windows 18 and 19, and the opposite terminal portions of the playing deck will be located below opposite goal means 27 and 28. In addition, the slat members 58–62 will include spaced-apart, crescent-shaped slots (see FIG. 4) that will be identical in size and shape to the crescent-shaped slots in the side members 13 and 14 and will be positioned to be in alignment with the aligned crescent-shaped slots in the side members 13 and 14 of the housing 11.

Figure 2:
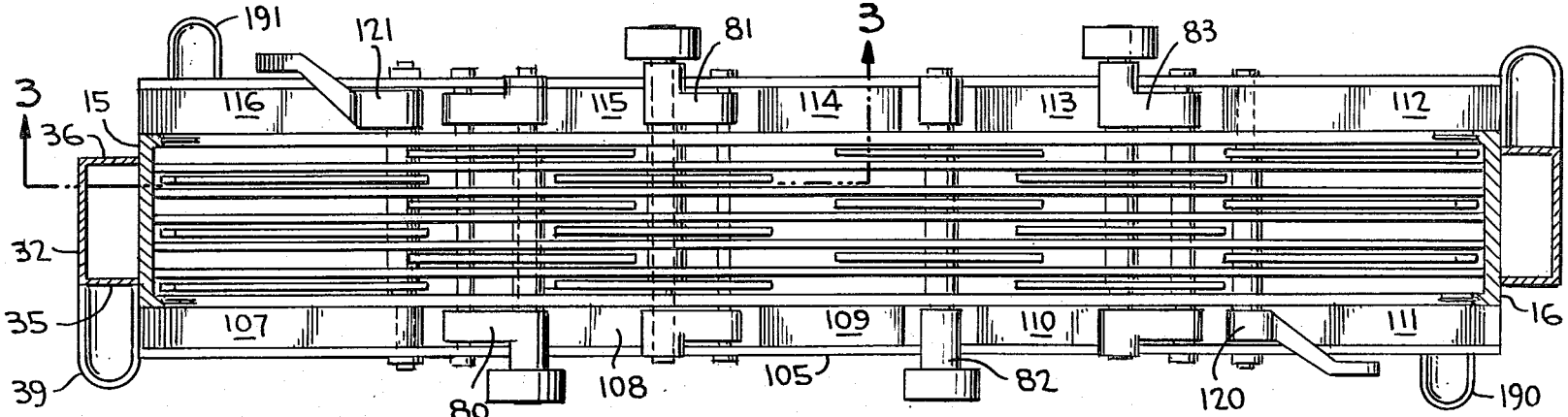
FIG. 2 shows a cross sectional view of the competition game device as seen along line 2—2 of FIG. 1.

Considering now the active game ball manipulation elements of the competition game device 10, as can be seen from FIGS. 1 and 2, these elements include two sets of translatable and rotatable activator elements 80, 82 and 81, 83 and two pivotable projector elements 120 and 121 (which projector elements are located at opposite ends of housing 11). One set of activator elements 80, 82 and one projector element 120 are operable by a game player (or players) positioned on one longitudinal side of the competition game device 10, whereas the other set of activator elements 81, 83 and the other projector element 121 are operable by a game player (or players) positioned on the opposite side of the device 10.

Figure 6:
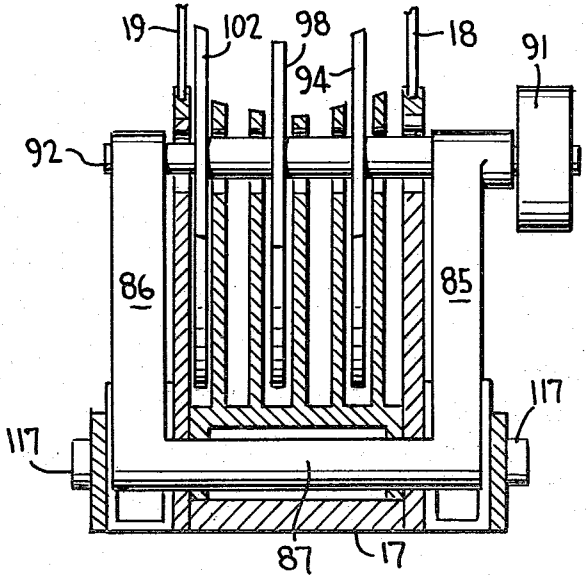
FIG. 6 depicts on the same scale as FIG. 5 a cross sectional view of the competition game device as seen along line 6—6 of FIG. 3.
Figures 8, 10, 12:
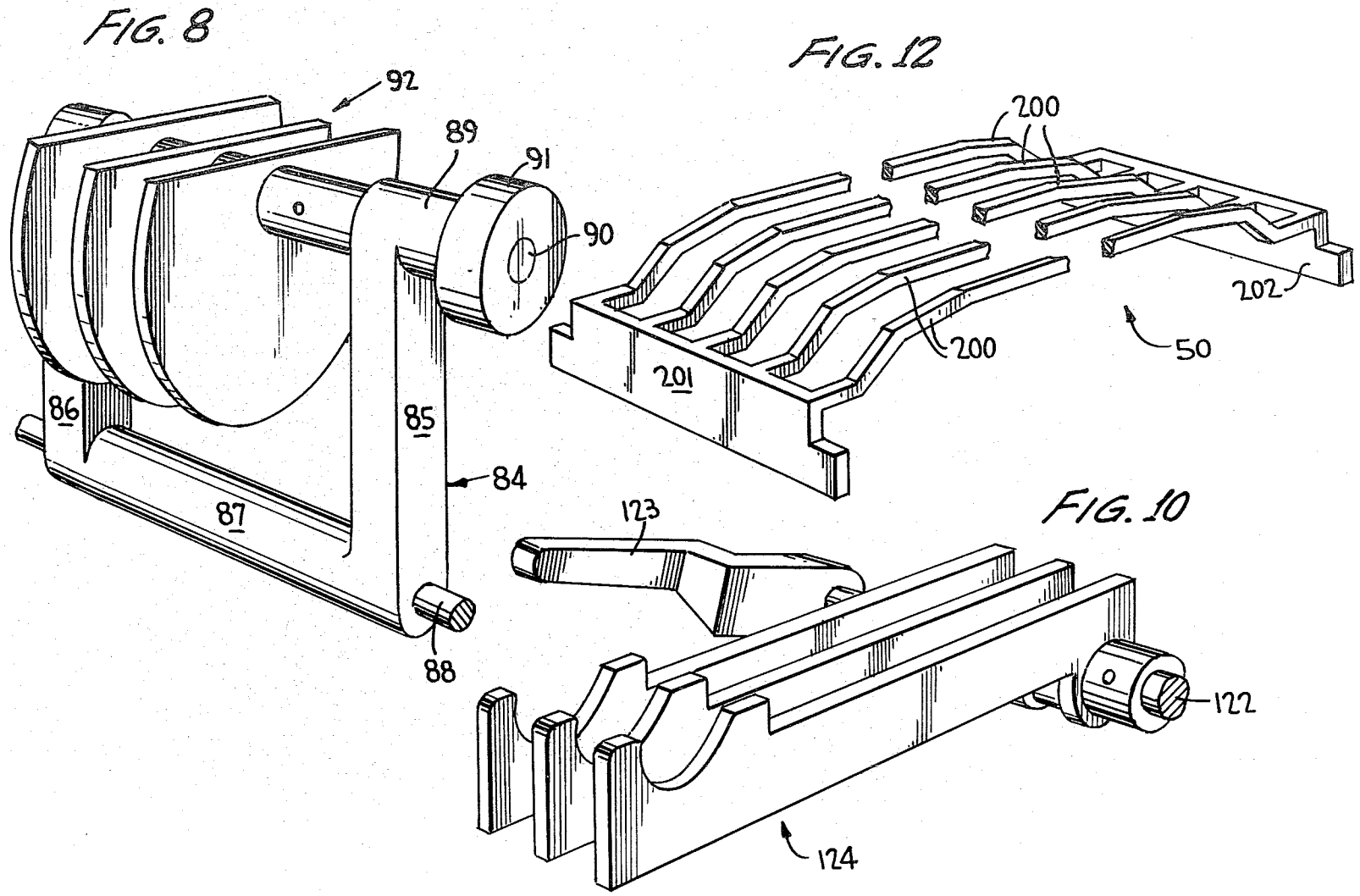
FIG. 8 shows a perspective view of a translatable and rotatable activator element used in the competition game device of FIG. 1.
FIG. 10 shows a perspective view of a pivotable projector element used in the competition game device of FIG. 1.
FIG. 12 shows a perspective view of an alternative configuration of flooring structure for use in the competition game device of FIG. 1, the alternative structure being in the form of a contoured grate.
Figure 9:
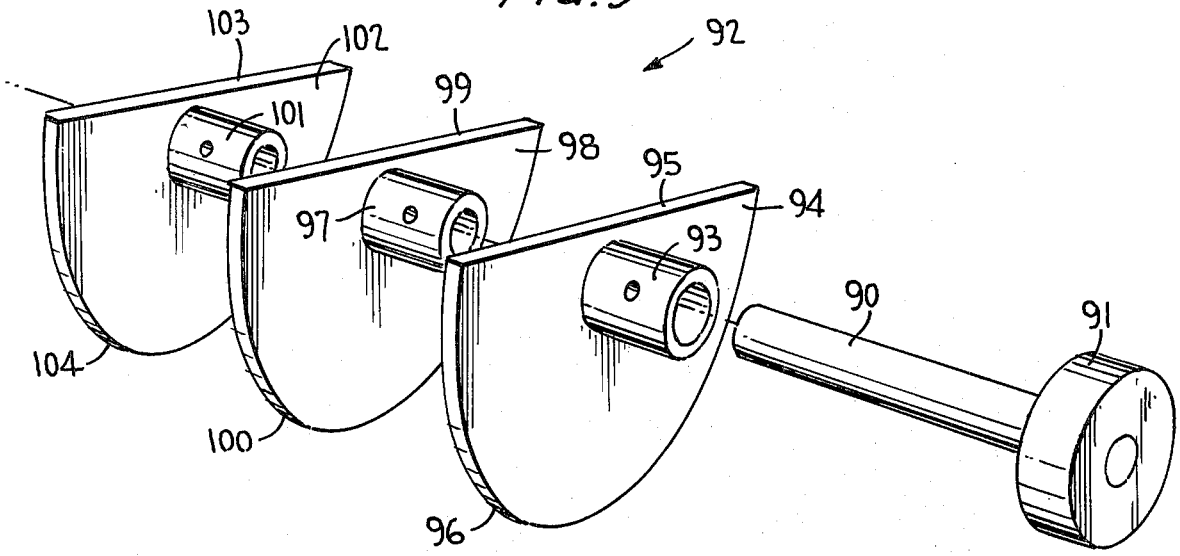
FIG. 9 shows an exploded view of a portion of the translatable and rotatable activator element shown in FIG. 8.

As best seen in FIGS. 6, 8 and 9, each of the activator elements, which are identical in construction, includes a unitary yoke 84 which is comprised of two parallel arms 85, 86 and a cross arm 87 that extends between corresponding first ends of the arms 85 and 86. A bore hole extends through the first ends of the arms 85, 86 and through the center of cross arm 87, and a rod 88 (around which the yoke 84 may be rotatable) extends therethrough. The second end of arm 85 includes a knob 89 which extends perpendicularly to the length of arm 85 and outwardly of the yoke 84, and aligned bore holes are located in the second end of both arm 86 and in the second end (including knob 89) of arm 85. A rotatable shaft 90 rotatably extends through these aligned bore holes and is fixed in position by an enlarged cylindrical head 91 at one end and a locking collar 92 at the opposite end (see FIG. 6). Fixedly attached to the rotatable shaft 90 along the center part of the portion thereof which extends between the arms 85 and 86 is a fin hub 92.

As shown in FIG. 9, fin hub 92 comprises a first portion which includes a first cylindrical sleeve 93 and an integral first plate-like activator fin 94, a second portion which includes a second cylindrical sleeve 97 and an integral second plate-like activator fin 98, and a third portion which includes a third sleeve 101 and an integral third plate-like activator fin 102. Aligned bore holes extend through each of the three fin hub portions so as to allow the shaft 90 to extend therethrough (the connection means fixedly connecting the first, second and third portions to the rotatable shaft 90 not being shown). Each of the plate-like activator fins 94, 98 and 102 includes a curved outer (striking) edge portion 95, 99 and 103 and a flat outer (striking) edge portion 96, 100 and 104. The activator fin 98 will be slightly smaller in dimensions than either of activator fins 94 or 103. The outer (striking) edge portions of the activator fins will, taken together, provide a "face" for contacting and suitably moving a game ball.

Of course in different embodiments of the present invention the plate-like activator fins 94, 98 and 102 can have differing outer (striking) edge configurations to provide differing operational effects on the game ball contacted thereby. For example, the edge portions 96, 100 and 104, instead of being flat, can be curved to form either convex or concave surfaces. In addition, the fins may be composed of resilient materials (to enhance the control of the game ball movement when contacted thereby). Their relative sizes can be changed as well, e.g., so as to conform to the contour of the playing deck adjacent thereto.

Referring to FIGS. 2 and 6, it can be seen that activator element 80 is dimensioned such that the cross arm 87 of the yoke 84 will extend through aligned slots in the lower side edges of side members 13 and 14 (which slots are respectively located below the crescent-shaped slot 13*a* in side member 13 and the corresponding slot (not shown) in side member 14) and through the corresponding aligned slots in the support flanges 55 and 56 which support base portion 54 of floor means 50 (the slot in flange 55 being shown but not labeled in FIG. 4). In addition, the arms 85 and 86 of yoke 84 will be dimensioned to allow shaft 90 (and the enlarged head 91) to fit within and be translatable along the associated crescent-shaped slot in side members 13 and 14, and the cylindrical sleeves of the first, second and third fin hub portions to fit within and along the aligned crescent-shaped slots in the slat members 58–62. Finally, the first, second and third portions of fin hub 92 will be dimensioned such that first, second and third plate-like activator fins 94, 98 and 102 will centrally fit within spaces 65, 67 and 69 between the slat members of the floor means 50.

Figure 7:
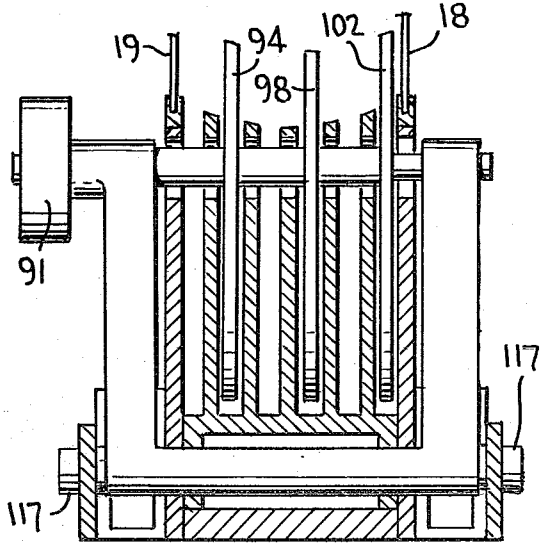
FIG. 7 depicts on the same scale as FIG. 5 a cross sectional view of the competition game device as seen along line 7—7 of FIG. 3.

As seen in FIGS. 1 and 2, activator element 82 is identical to activator element 80, and is similarly positioned such that its cross arm 87 extends through aligned slots in the lower side edges of side members 13 and 14 respectively located below the crescent-shaped slot 13*c* in side member 13 and the corresponding slot (not shown) in side member 14 and is positioned such that the shaft 90 will fit within and be translatable along the associated crescent-shaped slots in the side members and floor means slat members. On the other hand, activator elements 81 and 83 (see FIG. 7 which shows activator element 81) will be reversed in orientation, such that the enlarged cylindrical head 91 of the shaft 90 will be located on the outer side of the side wall 14, and the cross arms 87 thereof will be respectively positioned in aligned slots in the lower side edges of side members 13 and 14 respectively located below the crescent-shaped slot 13*b* in side members 13 and the corresponding slot (not shown) in side member 14, and the crescent-shaped slot 13*d* in side member 13 and the corresponding slot (not shown) in side member 14, as well as positioned such that their rotatable shafts 90 will fit within and be translatable along the associated separate crescent-shaped slots in the side members and floor means slat members. In addition, the first, second and third plate-like activator fins 94, 93 and 102 of activators 82 and 83 will centrally fit within respective spaces 64, 66 and 68 between the slat members of the floor means 50. Adjacent pairs of the activator elements (such as elements 80 and 81) are located along the longitudinal dimension of the competition game machine such that activator elements 80 and 81 will be translatable so as to have an area of overlapping interaction with respect to the playing deck surface when both activator elements are moved with their respective crescent-shaped slots to be closest to one another, (see FIG. 3) as well as to have respective areas of separate action when either activator element is moved within its associated crescent-shaped slots in side members 13 and 14 so as to be located at its furthest distance from the other activator element, and the same considerations apply to activator elements 82 and 83.

The ends of the rods 88 of each of the activators 80, 82, 81 and 83 will extend through holes in retaining strips 105 and 106 which are respectively positioned in spaced-apart fashion from the outer sides of side members 13 and 14 by spacer blocks 104–116. Locking nuts 117 are threadingly attached to the ends of each of the rods 88 and against the adjacent retaining strip to keep the respective rods positioned within the device 10.

Figure 5:
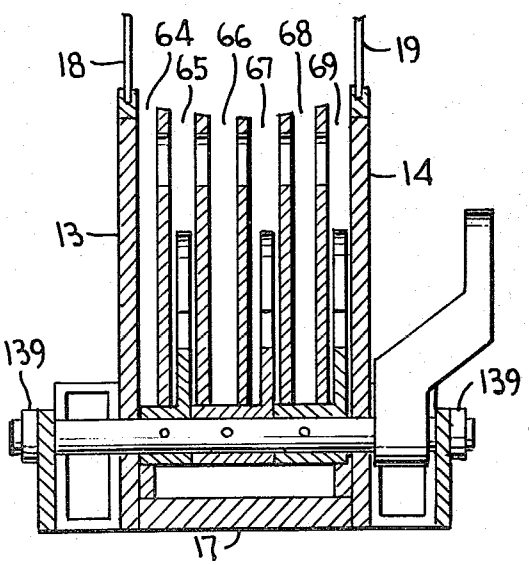
FIG. 5 depicts on a somewhat reduced scale a cross sectional view of the competition game device as seen along line 5—5 of FIG. 3.
Figure 11:
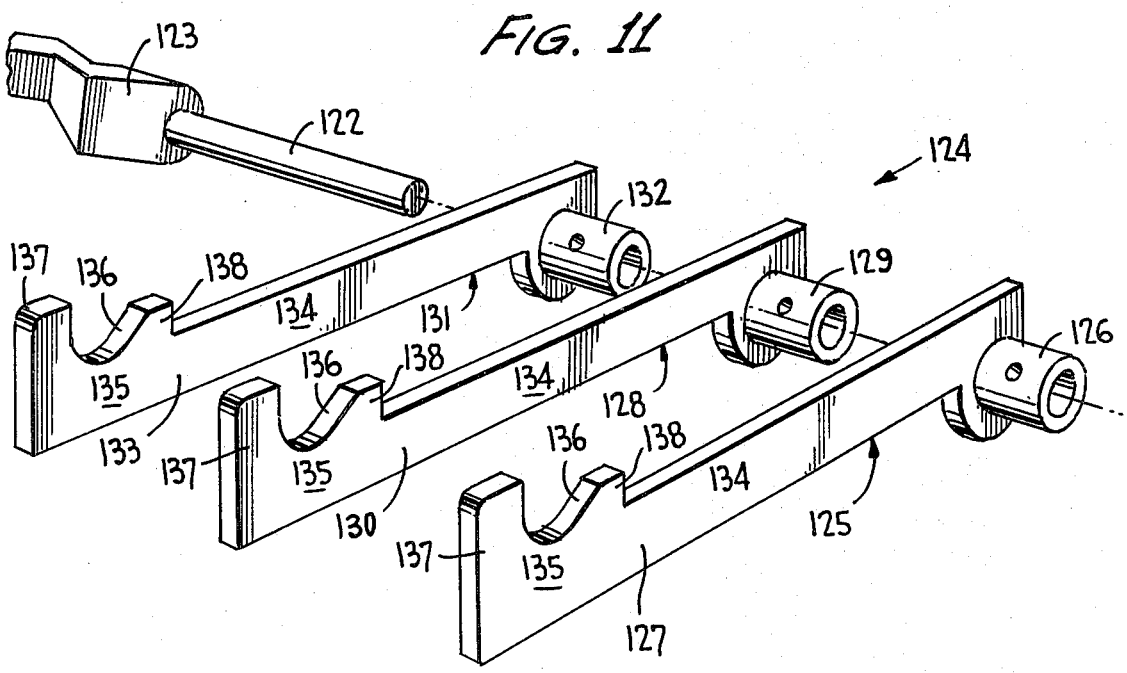
FIG. 11 shows an exploded view of a portion of the pivotable projector element shown in FIG. 10.

As best seen in FIGS. 5, 10 and 11, each of the pivotable projector elements, which are identical in construction, includes a rotatable shaft 122, a handle 123 which is fixedly attached to the rotatable shaft 122 near one end thereof, and a projector hub 124 which is fixedly attached to the rotatable shaft 122 along the center portion thereof between side members 13 and 14. The projector hub 124 comprises three aligned portions 125, 128 and 131, the first portion 125 including a first cylindrical sleeve 126 and an integral first projector arm 127, a second portion 128 including a second cylindrical sleeve 129 and an integral second projector arm 130, and the third portion 131 including a cylindrical sleeve 132 and an integral third projector arm 133. Aligned bore holes extend through each of the three projector hub portions so as to allow the rotatable shaft 122 to extend therethrough (the connection means fixedly connecting the first, second and third portions to the rotatable shaft 122 not being shown). Each of the projector arms 127, 130 and 133 are identical in construction and include elongated body portions 134 and head portions 135 which extend perpendicularly away from the body portions 134. Each head portion includes an indented portion 136 which separates an outer retention flange 137 and an inner retention flange 138, the outer retention flange 137 extending away from the body portion 134 a greater distance than the inner retention flange 138. As can be seen from FIG. 3, the indented portion 136 includes a generally flat segment 136*a* which extends from the top of the inner retention flange 138 towards the body portion 134, and a curved segment 136*b* which extends from the end of the segment 136*a* to the top of the outer retention flange 137.

Referring to FIGS. 2, 4 and 5, it can be seen that projector element 121 is positioned such that the rotatable shaft 122 extends transversely of housing 11 in channel X and fits through aligned holes near the lower side edges of side members 13, 14 and through aligned holes in spacer blocks 107 and 116. The channel X is large enough to allow the first, second and third cylindrical sleeves 126, 129 and 132 of the associated projector hub 124 to rotatably fit therewithin. Locking nuts 139 are threadingly attached to the ends of the rotatable shaft 122 to keep it in place. At the same time, the handle 123 and the first, second and third portions 125, 128 and 131 are located along rotatable shaft 122 and suitably dimensioned such that handle 123 will be positioned between the outer side of side member 14 and the retaining strip 106, and projector arms 127, 130, 133 will centrally fit within respective spaces 65, 67 and 69 of the floor means 50. As can be seen from FIG. 3, when the projector element 120 is in its rest position, the projector arms will rest on the top of base portion 51 of the floor means 50, and the indented portions 136 of the head portions 135 of each of the projector arms 127, 130 and 133 will be positioned above the surface of the terminal playing deck area (note also that when the projector element 120 is in its rest position, the generally flat segments 136*a* of the indented portions 136 of head portions 135 will be in alignment with the second descending portions 75 of the slat members 58–62).

The projector element 121 is identical to projector element 120 but is reversed in orientation with respect to housing 11, and is positioned at the opposite end of housing 11 such that its rotatable shaft 122 will extend transversely of housing 11 in channel Y and fit through aligned holes (not shown) near the lower side edges of side member 13, 14 and through aligned holes in spacer blocks 111 and 112. Like channel X, channel Y is large enough to allow the first, second and third cylindrical sleeves 126, 129 and 132 of the associated projector hub 124 to rotatably fit therewithin. Locking nuts are threadingly attached to the ends of rotatable shaft 122 to keep it in place, and the handle 123 will be positioned between the outer side of side member 13 and the retaining strip 105. At the same time the first, second and third portions 125, 128 and 131 will be located along shaft 122 and suitably dimensioned that projector arms 127, 130 and 133 will centrally fit within respective spaces 64, 66 and 68 between the slat members of the floor means 50.

The projector elements 120 and 121 allow the competing competition game machine players to project towards the goal means of the opposing player (or players) a game ball which has fallen onto the terminal playing deck portion of the playing deck located below the goal means which they are defending.

It should be noted that abutment stops (such as stops 180 and 181 shown in FIG. 1) can be suitably attached to the outer sides of the side members 13 and 14, if desired, to help limit the rotational movement of the yoke portions of the various activator elements to the extent desired. Also, the side members 13 and 14 can also include respective openings therein with cup-shaped entry troughs 190 and 191 attached to the outer sides for introduction of a game ball into the competition game machine as an alternative to the dropping of a game ball through opening 21 in the center of cover member 12. These entry channels will be suitably located to allow the game ball to be introduced into the game machine so as to roll upon the terminal portion of the playing deck beneath the goal means which the player is defending.

Depending on the particular game desired to be played within housing 11, a net (not shown) may be positioned transversely across housing 11 to alter the ways in which movement of a game ball from one end of the game machine to the other can be achieved. Such a net can be attached to the side members 13 and 14 after the cover member 12 has been disconnected and removed from attachment to the side and end members of the housing.

Turning now to FIG. 12 which shows a perspective view of an alternative configuration of flooring structure for use in the competition game machine constructed in accordance with the present invention, such a flooring means being dimensioned so as to fit within the housing 11, instead of consisting of a number of parallel slat members mounted on multiple base portions as shown in FIG. 4, can simply comprise a grate which will include multiple elongated spaced apart teeth 200 extending between supports 201 and 202 at the opposite ends thereof, the supports 201 and 202 being mountable on housing floor member 17 adjacent the opposite housing end members 15 and 16. The teeth can be suitably shaped along their longitudinal lengths so as to form the desired playing deck configuration. Cross elements (not shown) can be used for supporting adjacent teeth along their longitudinal lengths, these cross elements of course being located at points that would not interfere with the movement of projector element arms or activator element fins within the spaces defined therebetween.

When two (or more) players operate any of the competition game machine embodiments of the present invention, various modes of play can be followed; however, in each mode the object will be to project the game ball into the opponent's goal means by suitably hitting, tossing and/or bouncing the game ball within housing 11. Such actions will be achieved by a player's utilization of his activator and projector elements. Certain further features of the inventive game machine and basic criteria of operation and play are as follows.

A player can use his own projector element to toss a game ball towards the opponent's goal means. This can take place when the game ball has been introduced into the housing by means of the associated entry channel on the adjacent side member of housing 11 or when the game ball falls onto the terminal portion of the playing deck by other actions taking place within the housing. The tossing action of the projector element, which occurs by gripping and rotating handle 123, can take place either immediately upon contact by the game ball or after an interval of time (during which the game ball will come to rest), and the game ball will be projected due to its resting in (and contact by) at least two of the indented portions of the head portions on the projector arms of the projector element. When positioned in the noted indented portions of the projector arm head portions, the game ball cannot be reached by any of the opponent's elements.

The projector element can thus give the player the advantage of the exact timing, velocity and arc of his tossing of the game ball towards the oppenent's goal means. At the same time, it requires skill in getting the game ball past the opponent's activator elements (which elements can be positioned by the opponent to deflect or intercept the toss), in projecting the game ball so that it can be controlled by the player's own activator element located closer to the opponent's goal, and in projecting the game ball so as to avoid contact with the baffle plates.

On the other hand, the opposing player should be operating his activator elements to take control of the game ball and project it towards the other player's goal means.

Each translatable and rotatable activator element provides for a positive control in catching, holding, throwing and/or striking the game ball. Some of their features are as follows:

A. Gaining Control of a Moving Game Ball

1. With the enlarged end of the rotary shaft rotated such that the striking edges of the activator fins (forming a "face") will be perpendicular to the path of the oncoming game ball, the activator element can be moved in the approximate direction the game ball is traveling by moving the enlarged end such that the yoke pivots around its cross bar portion. The angular pivoting velocity should be decelerated after contact, thus slowing the movement of the game ball to achieve better control.

2. By rotating the enlarged end portion of the rotatable shaft such that the activator fins are in the correct position, and with proper timing, a game ball traveling near the playing deck surface can be trapped between the striking edges of the activator fins and the playing deck surface.

3. With the striking edges of the activator fins held at the desired angle, a moving game ball can be deflected vertically upwardly, and a further manipulation of the game ball can be achieved with its vertical descent.

B. Possession of the Game Ball

1. Each activator element is appropriately sized and located such that there is an associated area of the playing deck which is inaccessible to the fins of the opponent's adjacent activator element. Thus, a positive possession of the game ball can be achieved as long as it is kept in these areas.

2. Between the areas described in (1), there are playing deck areas where the activator fins of the opponent's adjacent activator element may be manipulated separately or simultaneously. When the game ball is in one of these areas it may be manipulated by either player.

3. When the game ball is dropped into play from the opening in the center of the cover element of the game machine housing, it will fall into an area described in (2); thus allowing an opportunity for either player to gain possession.

C. Throwing or Hitting the Game Ball

1. The game ball may be manipulated by either striking it with the fins of the activator element or by means of an accelerated push by the activator fins. It may either be hit or thrown.

2. The rotating of the activator fins alone will allow the game ball to be manipulated in a very limited manner, the direction and angle of thrust depending on the location of the game ball at the moment of contact.

3. The rotary action of the activator element yoke allows the entire element to be moved longitudinally along the playing deck. This permits the player to locate the center of rotation of the rotary activator element at any point within the range of its movement to get the desired direction of thrust to be applied to the game ball.

4. The rotating action of the activator fins and the rotary action of the yoke may be utilized simultaneously, thus providing such manipulations as horizontal thrusts, almost vertical thrusts, angled thrusts, thrusts toward either end of the machine and combination thrusts resulting in such actions as backspin on the game ball.

5. The action described in (4) also allows the game ball to be bounced back and fourth from the ends of the activator fins to the playing deck in a manner similar to dribbling.

Although two embodiments of the competition game machine of the present invention have been described in detail in the foregoing description and discussion, it will be apparent that many changes and modifications thereto could be made and the game machine would still fall within the scope of the appended claims.

We claim:

1. A competition game machine which comprises, (a) an elongated housing formed by a cover member, two side members, two end members and a bottom member, said side members including openings therein in which are mounted window elements, each of said side members including at least two cresecent-shaped slots therein, the crescent-shaped slots in one side member being aligned with the crescent-shaped slots in the other side member, said side members also including additional openings therein in the lower sides thereof, at least one of which is located below each of said crescent-shaped slots, each of said end members including an opening in the upper portion thereof which is sufficiently sized to allow a game ball to pass therethrough, (b) identical game ball return means mounted on the outer sides of each respective end member and capable of receiving a game ball passing through the opening in the respective end member, (c) a floor means positioned in said housing to form a playing deck above said bottom member, said floor means including multiple spaces therein which each extend from one end member of the housing to the other end and are spaced apart between the side members, (d) separate identical projector elements positioned near the two housing end members, each projector element including a rotatable projector shaft which extends between the housing side members and respectively through aligned holes therein, a handle means fixedly attached to one end of said rotatable projector shaft so as to be located outside said housing and capable of rotating said rotatable projector shaft, and a projector hub fixedly attached to said rotatable projector shaft along a center portion between said housing side members, said projector hub including multiple identically-shaped projector arms with head portions which are capable of retaining and, when said rotatable projector shaft is rotated, projecting a game ball towards the opposite housing end member, the handle means of each respective projector element being located on the outer side of an opposite side member, and the projector arms with head portions being capable of moving within and above different said spaces in said floor means, and (e) at least two separate and identical activator elements, each activator element including a yoke having two arms and a cross bar connecting first ends of said arms, said cross bar being rotatably mounted between the housing side members, the second ends of said arms including aligned bores through which extends a rotatable activator shaft having an enlarged end portion, each said rotatable activator shaft being translatable in aligned crescent-shaped slots in said side members, and each activator element including a fin hub fixedly attached to said rotatable activator shaft along a center portion between said housing side members, said fin hub including multiple identically shaped plate-like fins which are capable of moving within and above different said spaces in said floor means so as to form a striking face for contacting and moving a game ball.

2. A competition game machine as defined in claim 1 wherein said housing has a generally box-like shape and wherein an opening is provided in the center of said cover member to allow a game ball to be dropped into the interior of said housing.

3. A competition game machine as defined in claim 2 wherein each of said housing end members includes a means forming a goal on the inner side thereof which is capable of feeding a rolling game ball projected therein through the opening in the adjacent end member, each said goal means including a floor portion connected along one side to the adjacent end member along the lower edge of the opening therein and a rim portion connected to the opposite side of said floor portion so as to extend generally upwardly within said housing.

4. A competition game machine as defined in claim 3 wherein each said game return means includes a bottom return trough which includes a cup-shaped end portion, the bottom return trough being inclined so as to cause a game ball thereon to roll to said cup-shaped end portion for easy retrieval by the respective game machine player.

5. A competition game machine as defined in claim 4 wherein each of said housing side members includes four crescent-shaped slots therein, and wherein four activator elements are utilized in said game machine, alternate activator elements having handle means on the rotatable activator shafts thereof located on the outer side of the same side wall such that alternate activator elements are operable by separate players positioned on opposite sides of said game machine.

6. A competition game machine as defined in claim 5 wherein each of said plate-like fins of each said activator element is formed to have a curved outer edge portion and a flat outer edge portion.

7. A competition game machine as defined in claim 4 wherein each of said projector arms of each projector element includes an elongated body portion and a head portion, each said elongated body portion being sufficiently long to locate its head portion near the adjacent housing end member and beneath the nearest goal means, and wherein each said head portion includes an indented portion which, together with an identical indented portion in the head portion of at least one adjacent projector arm, is capable of supporting a game ball and projecting it towards the opposite housing end member when the projector element is rotated by rotation of said rotatable projector shaft.

8. A competition game machine as defined in claim 1 wherein said floor means defines a playing deck for the game ball within said housing which has a major portion which is parallel to the housing bottom member, two opposite first descending portions, two opposite second descending portions, and two opposite terminal portions.

9. A competition game machine as defined in claim 8 wherein said floor means includes multiple spaced apart slat elements mounted to extend upwardly from multiple base portions, said slat elements being shaped such that their upper edges, when taken together, will form said portions of said playing deck and said spaces of said floor means will be created therebetween.

10. A competition game machine as defined in claim 9 wherein each of said slat members includes multiple crescent-shaped slots which are aligned with one another and with the aligned crescent-shaped slots in said housing side members.

11. A competition game machine as defined in claim 8 wherein said floor means comprises a grate member which includes multiple spaced-apart teeth which are mounted at their opposite ends on support means, said support means being positionable on said bottom member of said elongated housing.

* * * * *